US005370431A

United States Patent [19]

Henninger et al.

[11] Patent Number: 5,370,431

[45] Date of Patent: Dec. 6, 1994

[54] APPARATUS FOR THE SANITARY GATHERING AND RETENTION OF ANIMAL WASTE FOR DISPOSAL

[76] Inventors: Ralph W. Henninger; Linda Henninger, both of 300 Mountain Shadows Dr., Sedona, Ariz. 86336

[21] Appl. No.: 225,954

[22] Filed: Apr. 8, 1994

[51] Int. Cl.[5] ..... A01K 29/00; E01H 1/12

[52] U.S. Cl. ..... 294/1.3; 294/99.2

[58] Field of Search ..... 294/1.3–1.5, 294/16, 25, 33, 55, 97, 99.1, 99.2; 15/104.8, 257.1, 257.4, 257.6, 257.7; 248/95, 99–101

[56] References Cited

U.S. PATENT DOCUMENTS

| | | | |
|---|---|---|---|
| 3,767,247 | 10/1973 | Wetzler | 294/1.3 |
| 4,215,887 | 8/1980 | Boots | 294/1.4 |
| 4,323,272 | 4/1982 | Fortier | 294/1.4 |
| 4,341,410 | 7/1982 | Summach | 294/1.3 |

FOREIGN PATENT DOCUMENTS

| | | | |
|---|---|---|---|
| 1001377 | 10/1989 | Belgium | 294/1.3 |
| 4024641 | 2/1992 | Germany | 294/1.3 |

*Primary Examiner*—Johnny D. Cherry
*Attorney, Agent, or Firm*—Baker, Maxham, Jester & Meador

[57] ABSTRACT

A device for gathering pet waste into a disposable bag without soiling anything other than the interior of the disposal bag. Two identical hinged members unfold from a flat closed position into an open position for use with one hand. In operation, an inverted bag is slipped over the two members in open position. After forming a cavity in the bag, the user gathers the pet waste into the cavity employing a scraping action of the arched crown on each of two loops and retains it therein by forcing together the two loops against the spring action of the two supporting members. The arched crowns act to scrape the soiled surface clean of waste and to lift the waste into the bag. When forced together, the crowns close the bag entrance and trap the waste in the open space formed within the two opposing loops. The user then merely reverses the bag, lifting the waste from the unsoiled device, and disposes of the bag and contents.

14 Claims, 3 Drawing Sheets

APPARATUS FOR THE SANITARY GATHERING AND RETENTION OF ANIMAL WASTE FOR DISPOSAL

BACKGROUND OF THE INVENTION

1. Field of the Invention

Our invention relates generally to apparatus for retrieving pet waste and specifically to a reusable device for gathering pet waste into a bag for sealing and disposal without soiling anything other than the disposable bag interior.

2. Discussion of the Related Art

It has been said that the American population is outnumbered by their pets. We are arguably outnumbered by our pet dogs alone, which number more than 250 million by some estimates. As these numbers increase, the public demand for animal regulation increases correspondingly, responsive to the public health and safety concerns related to the high population of pet animals.

Generally, pet owners residing in municipal regions are subject to ordinances requiring that their animals be leashed at all times in public and somehow restrained in private to prevent uncontrolled wandering. More recently, some municipalities have promulgated so-called "pooper-scooper" ordinances, which require pet owners to accept personal responsibility for collection and disposition of the waste material produced by their pet animals. A typical ordinance instituted recently in a medium-sized southwestern city provides that "to avoid criminal charges, you must immediately place the waste in a plastic bag, securely tied, then place it in a solid waste container." This ordinance specifies up to a $2,500 fine, six months in jail and three years on probation as penalty for violation. Clearly, the social trend that started years ago in the major northeastern cities has now spread to the relatively suburban southwest.

When pet owners are subject to both leash-laws and pooper-scooper ordinances, the owner is obliged to (a) "walk" his pet on a leash and (b) retrieve and dispose of pet wastes when and where the animal decides to relieve itself. This distasteful routine is familiar to all responsible dog owners and many bystanders. Because of the distastefulness of this routine, many less responsible dog owners leave the waste where it lies. The local legislative body responds to this problem by instituting severe sanctions for such behavior, such as the type of penalties exemplified above. Practitioners in the art respond to the problem by proposing means designed to minimize the unpleasantness of the gathering and disposal of such animal waste.

For instance, the term "pooper-scooper" originally denominated a long-handled mechanical apparatus well-known in the art for retrieving solid dog wastes without soiling the owners' hands. Unfortunately, the first such pooper-scooper was a large and awkwardly-configured device that is inconvenient to carry and soiled in use. In using this or later versions of a pooper-scooper, a rigid tray or scoop is employed to scoop up the waste material as best as possible, leaving soiled both the vicinity of the waste and the tray itself. Even if a disposable bag is placed within the tray, no means are provided for cleanly gathering all of the waste material into the bag, which omission usually obliges the user to employ a twig or other readily-available item as a tool (scraper) for manipulating the waste material from its lie into the bag.

Responsive to this problem, one practitioner has added a spring-loaded clip to the bottom of a scoop for retaining a disposable plastic bag in position while "scooping" the waste material. While such an improvement perhaps solves the problem of holding the disposable bag in position for one-handed use, it does nothing to improve the gathering operation. The user is still obliged to grab the nearest twig or other suitable disposable scraper to gather the material into the bag. As every dog owner knows, a simple unaided scooping action relying on collection by gravity alone is not sufficient to gather and retain looser material into a bag held only on one side.

Accordingly, pet-owners (and others) are often confronted with pet waste having available only an awkward scoop or shovel or, worse, a simple plastic bag for use together with whatever other "tools" may be afforded by their immediate environment. Human nature being what it is, such unpleasant pet waste is commonly left where it lies, creating social, public-health and legal problems for the pet owner and others. Other solutions known in the art such as disposable surgical gloves, paper tissues, sandwich bags and the like do little to reduce the well-known unpleasantness of the pet sanitation task. None of these alternatives provides for simple sanitary gathering and bagging of pet waste. Also, the suitable device should be convenient to carry in, say, a shirt or hip pocket, for ease of carrying along when "walking" the dog.

Accordingly, there is still a clear need in the art for a simple device that solves these problems of (a) awkwardness, (b) inconvenience, and (c) distastefulness associated with gathering and disposing of pet waste. These unresolved problems and deficiencies are clearly felt in the art and are solved by our invention in the manner described below.

SUMMARY OF THE INVENTION

The device of our invention solves the above problems by using two flexible elements hinged together at one end and each having an open loop with a flexible arched crown at the other end. The device is convenient because it lies flat when folded into a closed position and can be slipped easily into a pocket. It is sanitary in use because it is entirely covered by a disposable plastic bag when opened into position for use and never comes into contact with the pet waste. Finally, the device of our invention is advantageous for gathering loose waste material because the flexible arched crown on the two loops each operate to scrape and lift the waste material up into the bag and to tightly close the bag when forced together.

It is an object of our invention to provide a device for gathering pet waste material into a bag without soiling anything other than the interior of the disposable bag. It is an advantage of our invention that all parts of the device are covered during use by an inverted disposable bag such that only the interior of the bag comes into contact with the waste material.

It is another advantage of our invention that the device is disposed to tightly close the bag around the waste without extruding the contents. It is a feature of this device that the open loops permit the bag to be pinched closed by the flexible loop crown without loss of the contents.

It is another object of our invention to provide a waste-gathering implement that is convenient to carry.

It is an advantage of our invention that it folds to a closed storage position in which it is completely flat.

It is another feature of the preferred embodiment of our invention that the two-hinged members making up the device are structurally identical to one another, thereby minimizing production costs and complexity. The foregoing, together with other objects, features and advantages of our invention, will become more apparent when referring to the following specification, claims and the accompanying drawing.

BRIEF DESCRIPTION OF THE DRAWING

For a more complete understanding of our invention, we now refer to the following detailed description of the embodiment as illustrated in the accompanying drawing, wherein.

DESCRIPTION OF THE PREFERRED EMBODIMENTS

Figure 1:
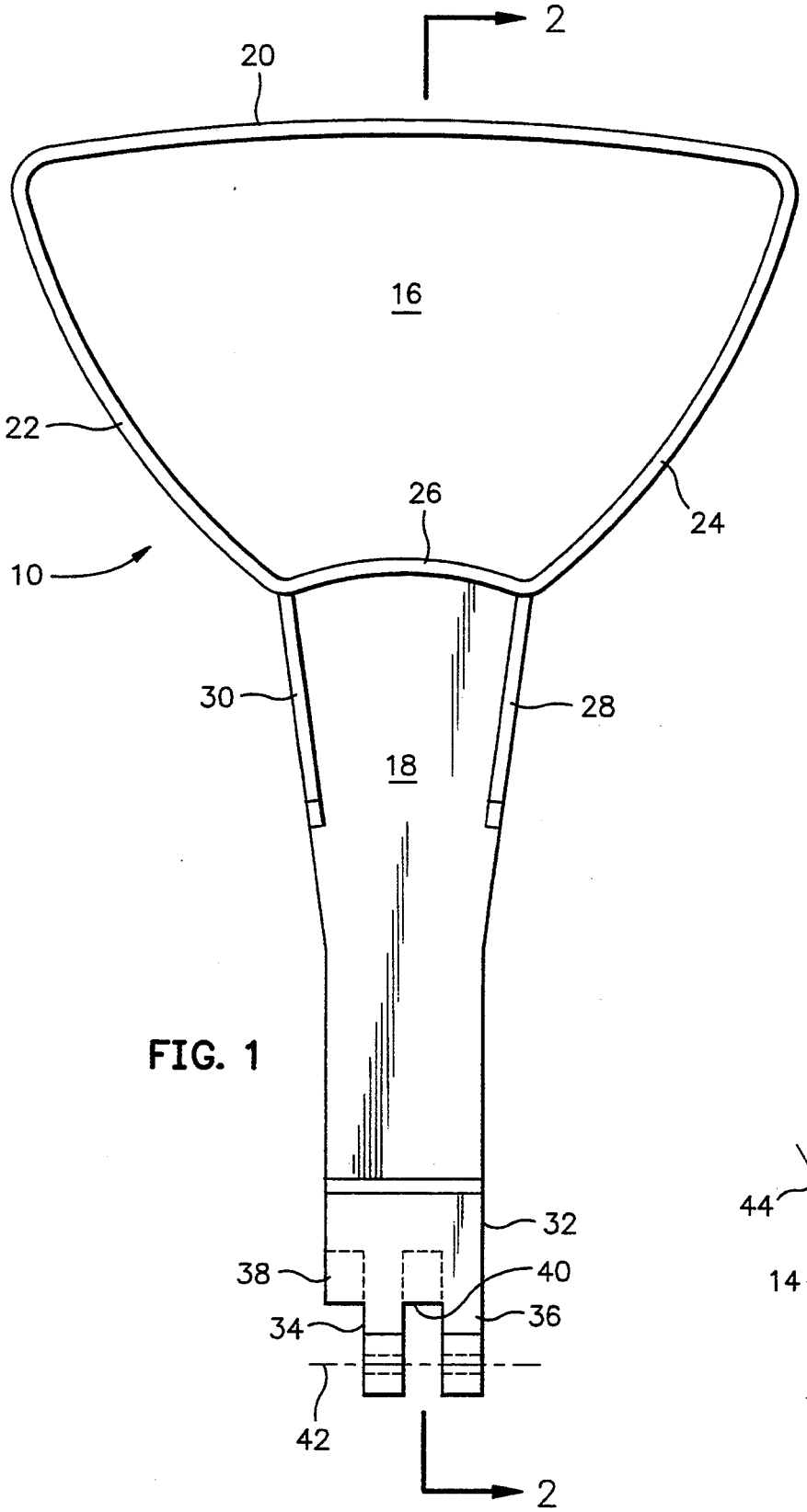
FIG. 1 is a top view of one of the two hinged members of the device of our invention.
Figure 2:
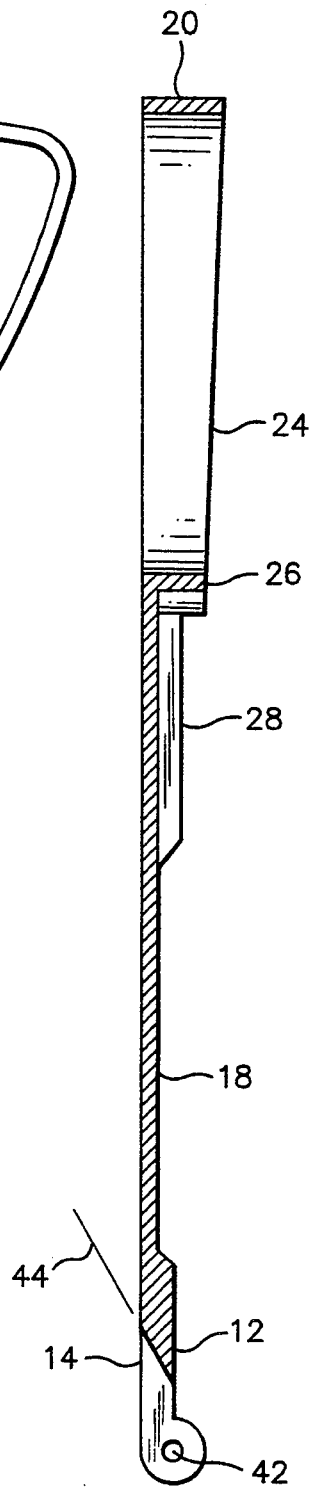
FIG. 2 is a cross-sectional view of the member of FIG. 1.

The device of our invention includes two hinged members exemplified by the member 10 of FIG. 1, which is a view of the front face 12 of member 10. FIG. 2 is a cross-sectional view of member 10 taken as shown in FIG. 1, which also shows the back face 14 of member 10. We prefer front face 12 and back face 14 to be generally parallel, although front face 12 is shown as having several different levels because of thickness variations related to changes in flexibility.

Member 10 includes the loop 16 coupled to a shank 18. Loop 16 includes four parts each having different functions. The crown 20 is coupled between the two side-rims 22 and 24, which are joined to the ends of a heel 26 substantially as shown. Heel 26 is permanently affixed to one end of shank 18. Member 10 is preferably made of a strong, flexible thermoplastic material and is suitable for one-piece injection molding.

Shank 18 has a thin cross-section to provide flexibility for the purposes discussed below. The two stiffeners 28 and 30 provide the additional strength necessary to properly couple shank 18 to loop 20 at heel 26.

The end of shank 18 opposite heel 26 is joined to a hinge 32. As used herein, hinge 32 includes both the knuckles 34 and 36 as well as the stops 38 and 40. Although one knuckle 36 and one stop 38 are sufficient, we prefer the two knuckles and two stops in an interleaved configuration substantially as shown. Knuckles 34 and 36 each are aligned on a hinge axis 42 so that both may turn about axis 42.

Stops 38 and 40 are aligned to the same plane, the edge of which is shown in FIG. 2 as the stop plane 44. Although we prefer the sloped stops 38 and 40 shown in FIGS. 1 and 2, any means for stopping the rotation of one member with respect to the other, as explained below, is suitable for use with the device of our invention, provided that such stops are aligned on some plane exemplified by plane 44. Of course, a single stop is sufficient for use with a single knuckle, and more than two of each may also be advantageously used.

Figure 3:
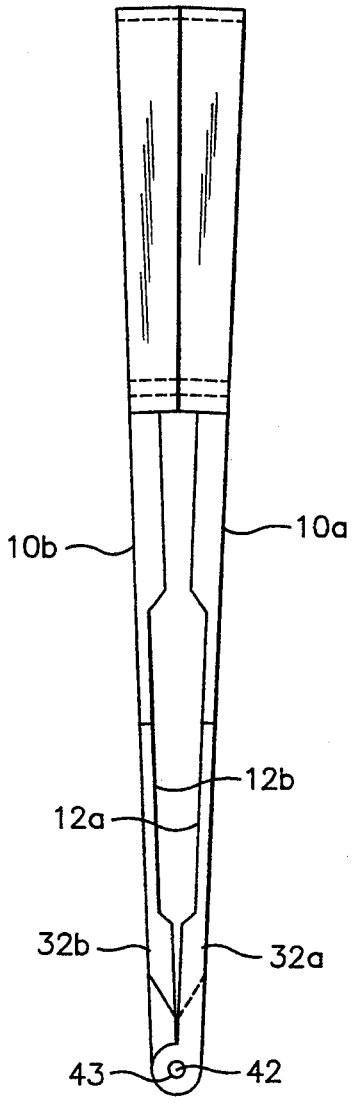
FIG. 3 is a side view of the two hinged members of the device of our invention folded into a closed position.

Hinge axis 42 is offset toward front face 12 from back face 14 sufficiently so that two hinged members can be closed against one another as shown in FIG. 3, which shows members 10A and 10B coupled to one another at hinges 32A and 32B so that the hinge axis for both coincides at hinge axis 42. This is accomplished by inserting a cylindrical pintle 43 through hinge knuckles 34A-B and 36A-B in a well-known manner. Although we prefer the use of twin knuckles 34A-B and 36A-B coupled by pintle 43, any hinging means known in the art suitable for application to this device may be employed provided that the members 10A and 10B can be rotatably coupled at hinge axis 42 to close with adjacent front faces 12A and 12B as shown in FIG. 3 and open against stops 38A-B and 40A-B as shown in FIG. 4.

Figure 4:
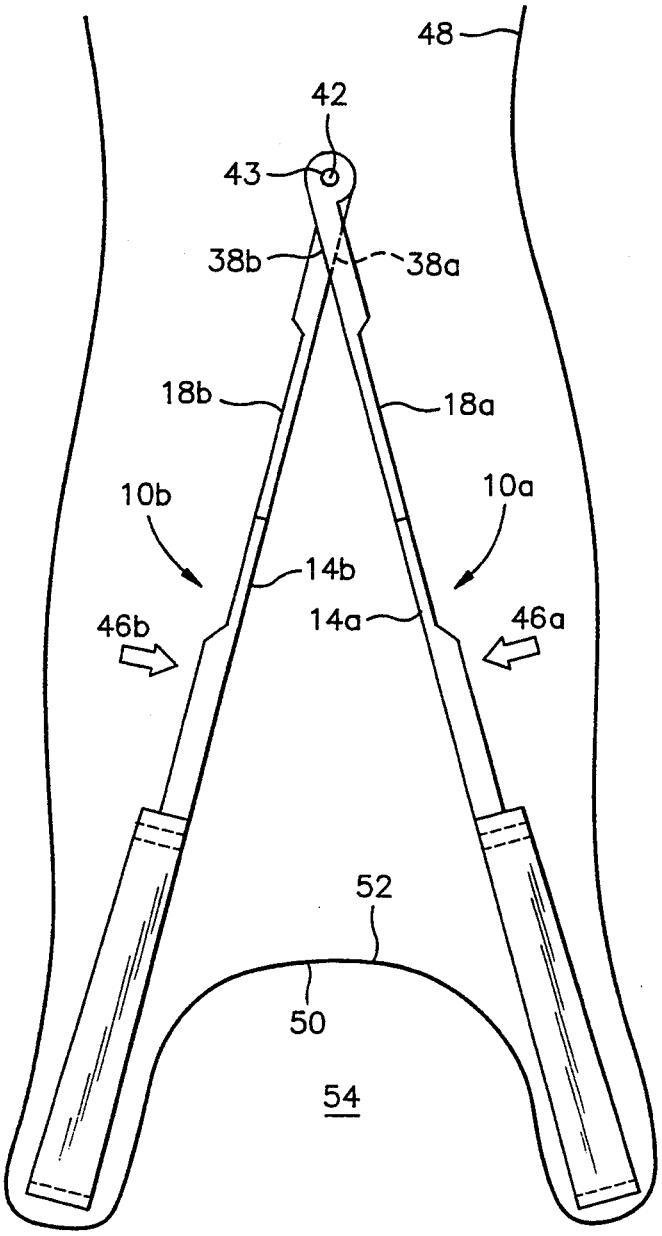
FIG. 4 is a side view of the device of FIG. 2 shown folded into an open position for use.

FIG. 4 shows the device of our invention opened into position for use. Member 10A is turned until it checks against stop 38B and member 10B is turned until it checks against stop 38A. Both members are turned on common hinge axis 42. Back faces 14A and 14B of both members can be forced together by applying pressure shown as forces 46A and 46B to deform the flexible shanks 18A and 18B. Such pressure can be easily applied with one hand.

Figure 5:
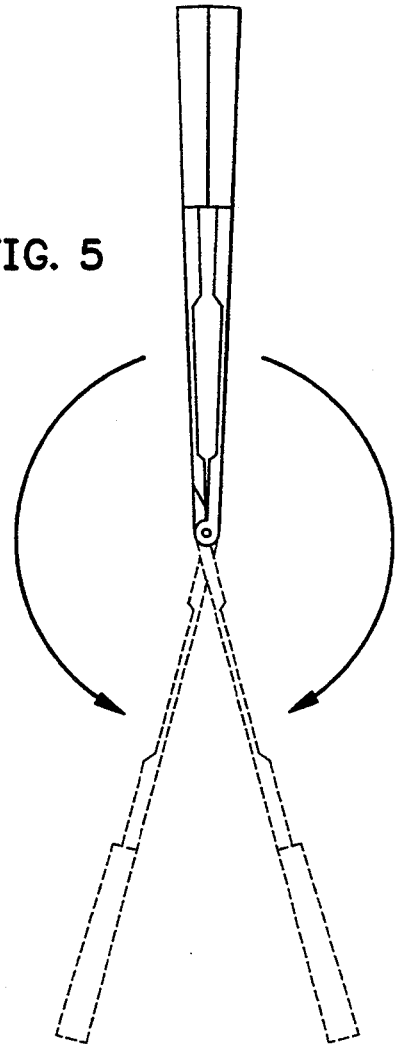
FIG. 5 demonstrates the unfolding operation necessary to transform the closed device of FIG. 3 into the open device of FIG. 4.

In operation, as shown in FIG. 3, the device of our invention can be folded to a closed position for convenient handling. When ready for use, the two hinged members 10A and 10B are swung open in the manner demonstrated in FIG. 5. When open, each member 10 engages its back face 14 against stop 38 of the other member substantially as shown. After opening, a bag 48 having an inner surface 50 and an outer surface 52 is inverted over members 10A and 10B as shown in FIG. 4. A pocket 54 is formed by urging bag 48 down between members 10A and 10B.

Figure 6A:
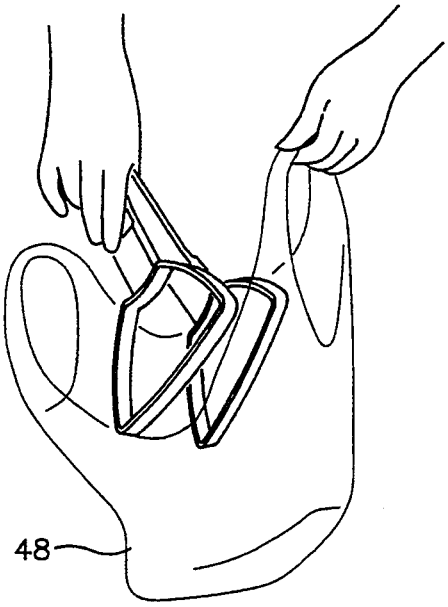
FIGS. 6A–D illustrate the preferred method of use for the device of our invention for gathering pet waste.
Figure 6B:
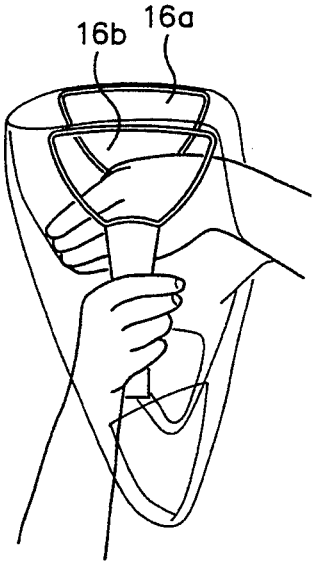
Figure 6C:
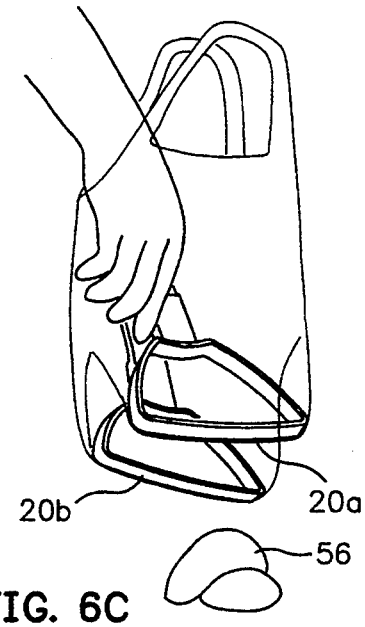

The preferred procedure for using the device of our invention is shown in FIGS. 6A–D. FIG. 6A shows the first step of inverting bag 48 over loops 16A-B of the device of our invention. FIG. 6B shows the formation of pocket 54 in bag 48. FIG. 6C shows the user, with one hand, engaging pet waste 56 by placing pocket 54 over waste 56. Once waste 56 is engaged, the user applies force (46A-B of FIG. 4) to close pocket 54 over waste 56. It is an important and advantageous feature of our invention that flexible crowns 20A and 20B then deform when forced against the surface (not shown) on which waste 56 lies. Because of the flexible bowed shape of crown 20, it flattens under pressure and operates to scrape and lift pet waste 56 cleanly from the supporting surface into pocket 54. Because bag 48 completely covers crowns 20A-20B, they are not soiled by such use.

Figure 6D:
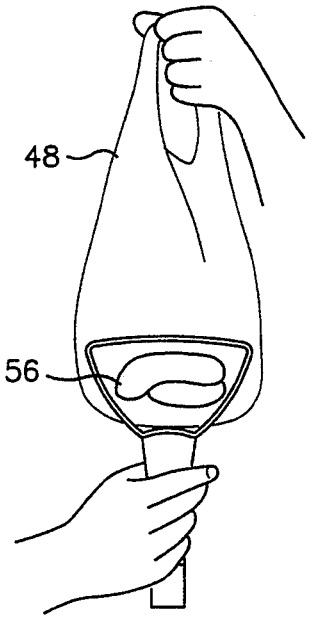

FIG. 6D shows bag 58 turned inside out by the user for disposal. Waste 56 is held in the cavity formed between the two loops 16A-B, which are held together by forces 46A-B applied by the user. Because crowns 20A-20B are forced together, waste 56 is held tightly to the cavity formed by bag 48 within loops 16A-B and cannot fall out or otherwise escape during lifting and other manipulation of the bag and its contents. Pressure is released from the two hinged members 10A-B once bag 48 is inverted, and the bagged contents are then ready for immediate disposal.

Clearly, other embodiments and modifications of our invention will occur readily to those of ordinary skill in the art in view of these teachings. Therefore, our invention is to be limited only by the following claims, which include all such embodiments and modifications when viewed in conjunction with the above specification and accompanying drawing.

We claim:

1. An apparatus for gathering waste into a bag, said apparatus comprising:

a first member having front and back faces and having a loop joined to a hinge by a flexible shank;

said loop including a flexible crown joined by two side-rims to a heel coupled to said shank;

said hinge including one or more knuckles aligned on a hinge axis and one or more stops disposed in a plane lying athwart said member from said front face to said back face;

a second member having front and back faces and having a loop joined to a hinge by a shank, said hinge having a hinge axis; and pintle means coupled to said first member hinge and said second member hinge for rotatably joining said first member to said second member such that said hinge axis of one said member coincides with said hinge axis of the other said member, whereby said first and said second members can be rotated about said hinge axes so that said front face of one said member lies adjacent said front face of the other said member.

2. The apparatus of claim 1 wherein said second member is substantially identical to said first member.

3. The apparatus of claim 2 wherein said flexible crown has a bowed shape that flattens under pressure.

4. The apparatus of claim 3 wherein said flexible shank is deformable in a direction substantially normal to said from face.

5. The apparatus of claim 4 wherein said from face is substantially parallel to said back face.

6. The apparatus of claim 5 wherein said loop is disposed in a plane substantially parallel to said from face.

7. The apparatus of claim 6 wherein said hinge axis is disposed in a plane substantially parallel to said from face.

8. The apparatus of claim 2 wherein said from face is substantially parallel to said back face.

9. The apparatus of claim 8 wherein said loop is disposed in a plane substantially parallel to said front face.

10. The apparatus of claim 9 wherein said hinge axis is disposed in a plane substantially parallel to said front face.

11. The apparatus of claim 1 wherein said flexible shank is deformable in a direction substantially normal to said front face.

12. The apparatus of claim 11 wherein said front face is substantially parallel to said back face.

13. The apparatus of claim 12 wherein said loop is disposed in a plane substantially parallel to said front face.

14. The apparatus of claim 1 wherein said flexible crown has a bowed shape that flattens under pressure.

* * * * *